US008974242B2

(12) United States Patent
Lee et al.

(10) Patent No.: US 8,974,242 B2
(45) Date of Patent: Mar. 10, 2015

(54) POSABLE STRAIN RELIEF FOR A CABLE

(75) Inventors: Noel Lee, Las Vegas, NV (US); Kendrew Lee, Tsing Yi (HK); Jacky Hsiung, San Jose, CA (US); David Leung, San Mateo, CA (US)

(73) Assignee: Monster, LLC, Las Vegas, NV (US)

( * ) Notice: Subject to any disclaimer, the term of this patent is extended or adjusted under 35 U.S.C. 154(b) by 28 days.

(21) Appl. No.: 13/587,860

(22) Filed: Aug. 16, 2012

(65) Prior Publication Data

US 2014/0051279 A1 Feb. 20, 2014

(51) Int. Cl.

| | |
|---|---|
| ***H01R 13/52*** | (2006.01) |
| ***H01R 13/56*** | (2006.01) |
| ***H01R 13/58*** | (2006.01) |

(52) U.S. Cl.

CPC ..... *H01R 13/562* (2013.01); *H01R 13/5833* (2013.01); *H01R 13/5841* (2013.01); *H01R 13/567* (2013.01)

USPC ..... 439/278

(58) Field of Classification Search

USPC ..... 439/278, 399, 445, 447, 450, 452, 455, 439/456, 459, 460, 463, 464, 465–468, 471, 439/569, 578–595, 606, 668, 901, 936; 174/72 A, 72 R, 76, 93, 68.1, 68.3, 73.1, 174/86, 89, 140 R, 140 S, 13, 40, 69, 135, 174/70 S, 84 R

See application file for complete search history.

(56) References Cited

U.S. PATENT DOCUMENTS

| | | | | |
|---|---|---|---|---|
| 4,718,860 | A | 1/1988 | Gobets | |
| 4,941,844 | A * | 7/1990 | Bowden et al. | 439/425 |
| 5,030,135 | A | 7/1991 | Plesinger | |
| 5,113,037 | A * | 5/1992 | King et al. | 174/87 |
| 5,202,942 | A | 4/1993 | Collins | |
| 6,068,622 | A | 5/2000 | Sater | |
| 6,280,050 | B1 * | 8/2001 | Bird et al. | 362/198 |
| 8,063,548 | B2 | 11/2011 | Bishop | |

* cited by examiner

*Primary Examiner* — Abdullah Riyami
*Assistant Examiner* — Harshad Patel
(74) *Attorney, Agent, or Firm* — John Nielsen; Sentinel IP

(57) ABSTRACT

A posable strain relief for use with a cable which can he bent into a particular shape by the user, and which retains that shape, thus allowing modification to suit a specific environment or use.

3 Claims, 4 Drawing Sheets

POSABLE STRAIN RELIEF FOR A CABLE

INTRODUCTION

The present invention concerns the construction of conductive cables. The invention relates to a flexible cable with a strain relief which can be bent into a particular shape by the user, and which retains that shape. This allows the user to modify the integrated strain relief to suit a specific environment or use.

BACKGROUND OF THE INVENTION

Electronics have been shrinking since their inception. With decreased cost, size, weight, and power consumption comes increased adoption and portability. "Personal" electronics have become ubiquitous. Solid-state music players only slightly larger than a pack of gum store hundreds, sometimes thousands of songs which are instantly accessible, Rand-held computing devices like mobile phones now have the ability to capture, edit, and publish a variety of digital media. Sophisticated video production is now possible on many such devices, some of which are roughly the size of a. deck of playing cards.

As portability increases, so does the diversity and harshness of environments in which those devices are used, and demand for devices and accessories accommodating harsher environments is rising. Athletic clothing designs increasingly include pockets meant to conveniently accommodate personal electronics. More products boast increased resistance to temperature fluctuation, humidity, shock or fluid submersion.

Despite a trend to develop wireless electronic accessories, cables continue to serve useful and necessary purposes. As inexhaustive examples, the fidelity of tethered audio and video transmission remains far superior to wireless counterparts. Small scale wireless power remains inefficient over any useful distance, and impractical in some environments. Efficiency and capacity of cable-based digital data transmissions continues to exceed portable wireless methods. However, cable design and versatility has not kept pace with the diversity of environments in which they are now used.

Existing cable connector and strain relief designs are generally of a fixed or rigid shape which cannot be manipulated without defeating or negatively impacting the protections those designs are meant to provide. Attempts at deformation either destroy cable components, damage the device to which the cable is attached, or both. Disparate environments can require different shapes for the same application. For example, a wired headset connected to a mobile phone may benefit from a bend near the device to minimize protrusion when stored in one's pocket, but may require a relatively straight path near the device to avoid collision with a mounting bracket in one's car. Physically active persons may wear a variety of devices on different parts of their bodies. A fixed form may undesirably position the cable to interfere with movement, resulting in distraction or abrasion.

Tight bends are often most convenient if present very close to the device, typically (and frustratingly) within the very space occupied by rigid cable connector designs. Some "low-profile" cable connectors are designed with fixed angles (right angles are common), but they remain rigid and incapable of adapting to varying environments, Users may require, for example, an oblique bend near the device in one environment, an acute bend in a second application, no bend in a third, and multiple bends in a fourth. Users today are faced with either purchasing multiple cables (if they can find the shapes they need), or futilely attempting to contort one cable into a shape outside of its intended use, thereby risking premature failure, damage, and loss of investment. A cable that can accommodate arbitrary bends near the device is needed.

SUMMARY OF THE INVENTION

The present invention relates to a posable strain relief. "Posable" can be defined as being subject to plastic deformation, or as having the property that once bent, the resulting position or form is held until re-bent.

In one embodiment, the posable strain relief comprises a housing, and one or more integral posable inserts. The housing is constructed of a relatively flexible material, and the posable insert is either partially or completely embedded within the housing material. The posable strain relief has a cavity which allows one or more elongated objects (like cables) to pass completely through the posable strain relief The posable strain relief may be affixed to the elongated object in such a way as to prevent changes in the relative longitudinal positions of the posable strain relief and the elongated object.

The housing is generally prone to elastic (nonpermanent) deformations, whereas the posable insert is generally prone to plastic (permanent) deformations. The posable insert is relatively rigid compared to the flexible housing and exhibits plastic deformation under a threshold force which is higher than that applied during typical use, but low enough to be applied by one's hands with minimal effort. The posable insert may be constructed to favor deformation in one plane.

In a further embodiment, the posable strain relief may be affixed to a cable connector. The cable connector comprises one or more signal conductors with one or more pinouts. In that embodiment, the posable strain relief typically surrounds the pinout, and a portion of the signal conductor.

In a further embodiment, the cable connector may be affixed to one or more flexible cables having one or more the conductive leads. In that embodiment, the flexible cable typically resides in the cavity. The conductive lead connects to the signal conductor at the pinout. The posable strain relief typically surrounds the pinout and a portion of the flexible cable. The posable insert is typically oriented substantially parallel to the portion of the flexible cable. Both the flexible cable and the signal conductor typically protrude from the posable strain relief. Where advantageous, the posable strain relief may be formed to prevent the posable insert from contacting part or all of the conductive lead, signal conductor, or pinout.

In a further embodiment, a second flexible material comprises an interior mold which replaces a volume inside the housing. In that embodiment, the housing typically surrounds the interior mold in its entirety.

At rest, the flexible materials in each embodiment tend to conform to the shape of the posable insert. The construction allows the user to easily change the shape of the posable strain relief to suit the user's needs. The posable strain relief retains that shape absent additional input from the user. The relative rigidity of the posable insert also relieves strain on the more flexible materials which would otherwise be subject to more frequent deformations during active use.

A particular advantage of the present invention is that by virtue of its configuration, it can be bent numerous times in varying directions without breaking or shearing and without loss or degradation of signal over time. This further allows the user to reliably route a flexible cable in any direction or angle that improves ergonomics and usability in a variety of environments.

DETAILED DESCRIPTION OF THE EMBODIMENTS

The following describes preferred embodiments. However, embodiments of the invention are not limited to those embodiments. Therefore, the description that follows is for purpose of illustration and not limitation. Other systems, methods, features and advantages will be or will become apparent to one with skill in the art upon examination of the following figures and detailed description. It is intended that all such additional systems, methods, features and advantages be included within this description, be within the scope of the inventive subject matter, and be protected by the accompanying claims.

Figure 1:
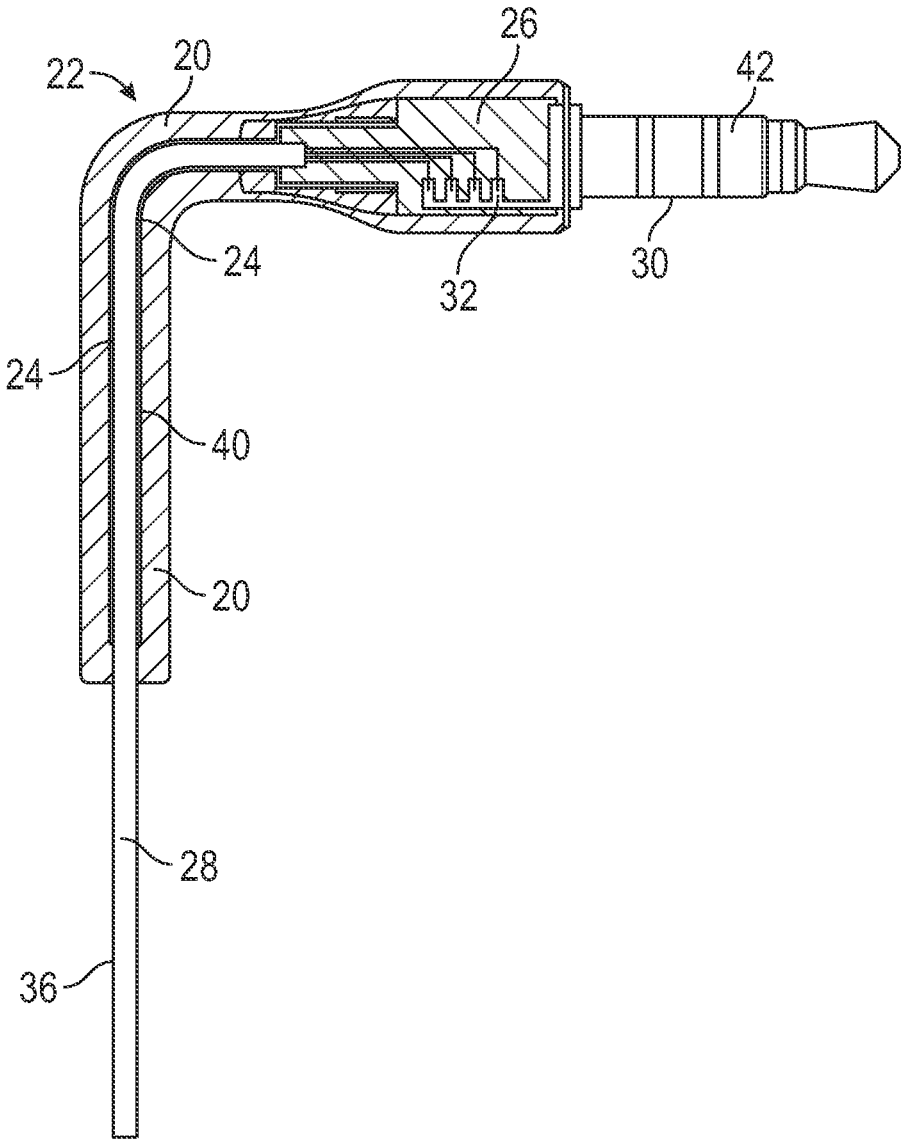
FIG. 1 illustrates a cross-sectional view of the posable strain relief integrated with a cable connector.

FIG. 1 illustrates a cross-sectional view of one embodiment comprising a posable strain relief a cable connector 30, and a flexible cable 28. The posable strain relief 22 comprises a housing 20, a cavity 40, and one or more posable inserts 24. The posable insert 24 is typically partially or entirely embedded in or enclosed by the housing 20, and typically run substantially parallel to the cavity 40.

The posable insert 24 may be rectangular, allowing deformation along its shortest axis more easily than other axes. As depicted, this would favor deformation in the plane of the cross section (or paper). Where more than one posable insert 24 is present, they are typically similar in shape and material and parallel to each other. Different combinations of materials, shapes and orientations may he combined to achieve desired deformation characteristics.

The cable connector 30 typically comprises one or more signal conductors 42 (e.g., a TS-, TRS- or TRRS-style connector as depicted) connected to one or more pinouts 32. The flexible cable 28 comprises one or more conductive leads 34 which may be partially or fully enclosed by an insulating jacket 36. The conductive lead 34 connects to the cable connector 30 at the pinout 32. Where a cable connector 30 or flexible cable 28 is present, the posable strain relief 22 is typically constructed to surrounds the pinout 32 during use. In this case, the posable strain relief 22 is also typically constructed to surround a portion of the cable 28, and a portion of the cable connector 30.

In the depicted embodiment, the posable strain relief 22 further comprises an interior mold 26. The interior mold 26 is typically surrounded by the housing 20 and may be partially surrounded by the posable inserts 24.

Material Selection for Various Components of the Plug

The housing 20 and the interior mold 26 are typically constructed of plastic. For example, in the plastic may comprise Polyvinyl Chloride (PVC) or Thermoplastic Elastomer (TPE), as is typical with the housing 20, or the plastic may comprise Low Density Polyethylene (LDPE) or Polypropylene (PP), as is typical with the interior mold 26. The posable insert 24 is typically constructed of metal. For example, the metal may comprise stainless steel, sheet metal, or copper.

Figure 2A:
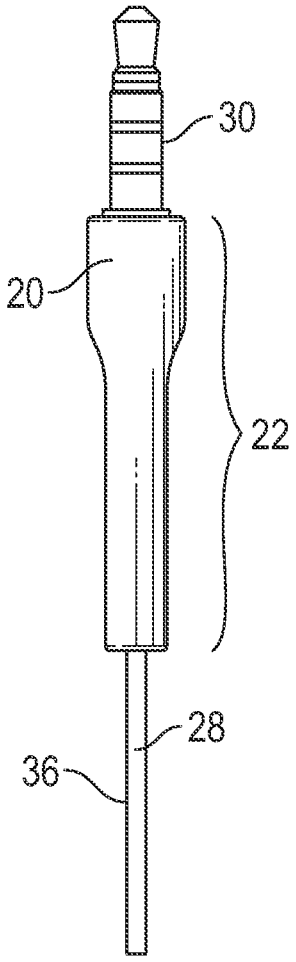
FIGS. 2A & 2B illustrate the exterior of the posable strain relief of FIG. 1 from different angles.
Figure 2B:
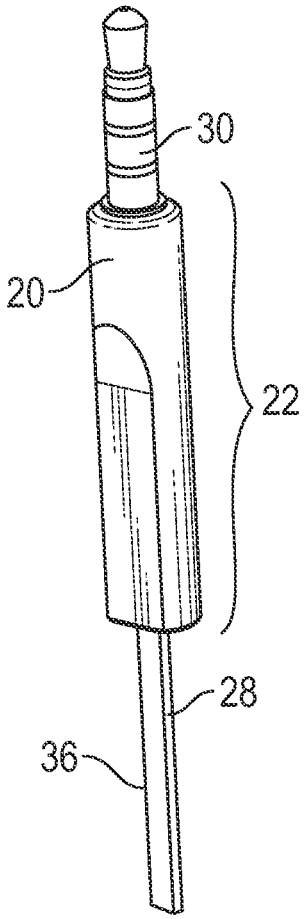

FIGS. 2A and 2B illustrate different angles of the exterior of the integrated posable strain relief 22 depicted in FIG. 1. From the exterior, the housing 20 of the posable strain relief 22, the signal conductors 42 of the cable connector 30, and the insulating jacket 36 of the flexible cable 28 are visible.

Figure 3B:
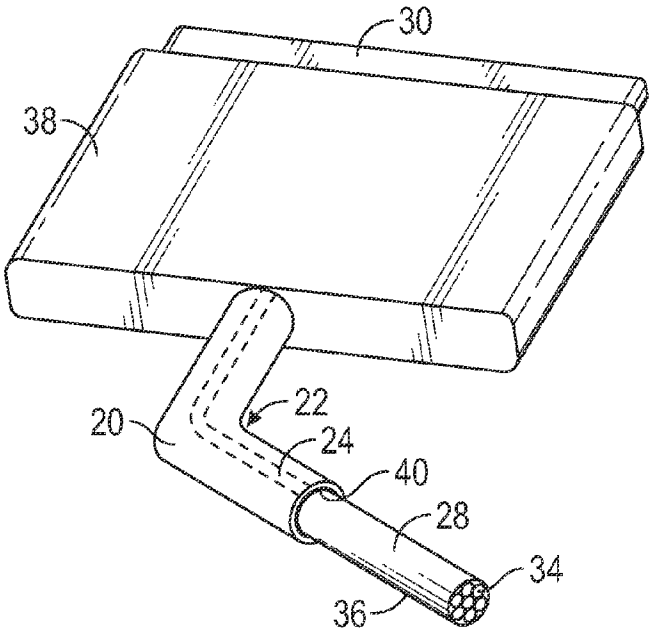
FIGS. 3A & 3B illustrate an alternate embodiment of the posable strain relief integrated with a cable connector with a rigid housing.
Figure 3A:
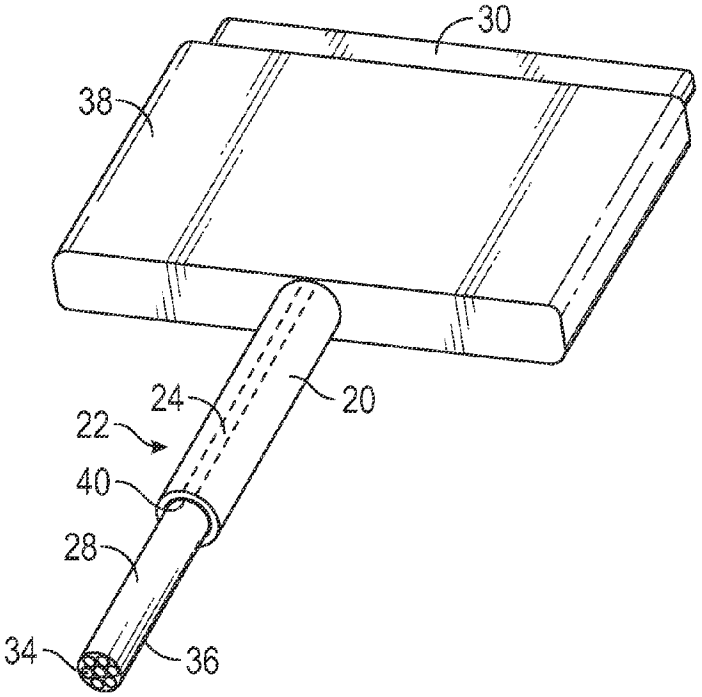

FIGS. 3A and 3B illustrate another embodiment comprising a posable strain relief 22, a flexible cable 28, and a cable connector 30 having a rigid housing 38. The cable connector 30, the flexible cable 28, and the posable strain relief 22 protrude from the rigid housing 38. In this embodiment, the posable strain relief 22 may or may not surround the pinout 32 (not pictured) which may reside inside the rigid housing 38. The posable insert 24 is embedded in the housing 20 of the posable strain relief 22. The flexible cable 28 comprises an insulating jacket 36 and several conductive leads 34. The flexible cable 28 passes through the cavity 40 of the posable strain relief 22.

Figure 4:
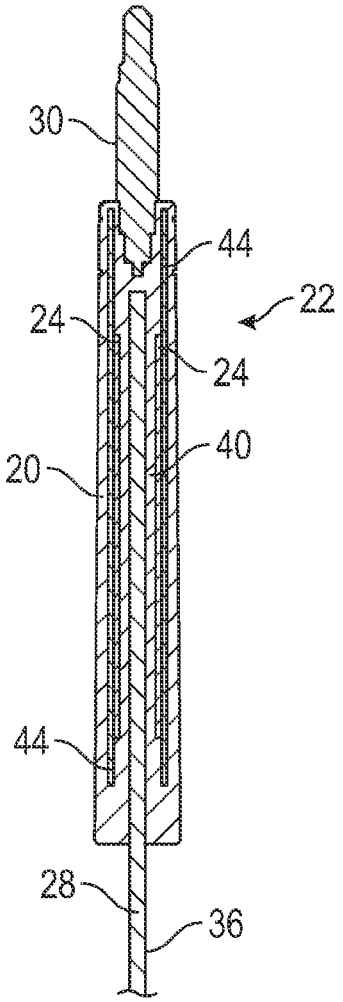
FIGS. 4 & 5 illustrate an alternate embodiment of the posable strain relief integrated with a cable connector.
Figure 5:
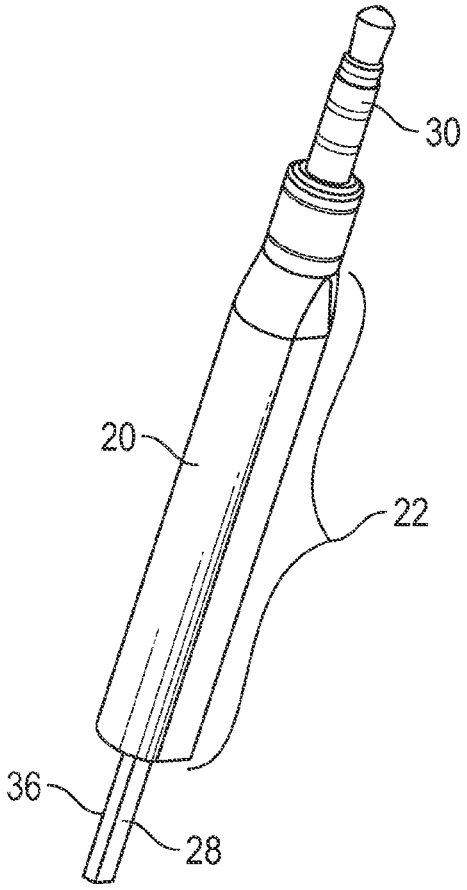

FIGS. 4 and 5 illustrate another embodiment comprising a posable strain relief 22, a flexible cable 28, and a cable connector 30, a housing 20, a cavity 40, and one or more posable inserts 24. In this embodiment, the posable insert 24 is a wire mesh cylinder that is substantially surrounded by a shrink tube 44, and which is entirely embedded in or enclosed by the housing 20, and runs substantially parallel to the cavity 40. The flexible cable 28 comprises an insulating jacket 36 and several conductive leads 34 (not pictured). The flexible cable 28 passes through the cavity 40 of the posable strain relief 22.

We claim:

1. A strain relief for relieving strain on a cable, the strain relief comprising:
- a. a flexible housing having a cavity along its longitudinal axis;
- b. at least one posable insert which:
  - i. is disposed substantially parallel to, but outside the cavity; and
  - ii. is substantially surrounded by the flexible housing,
- c. wherein the shape of the posable insert is an extrusion whose cross-section is a rectangle.

2. A strain relief for relieving strain on a cable, the strain relief comprising:
- a. a flexible housing having a cavity along its longitudinal axis;
- b. at least one posable insert which:
  - i. is disposed substantially parallel to, but outside the cavity; and
  - ii. is substantially surrounded by the flexible housing,
- c. wherein the shape of the posable insert is an extrusion whose cross-section is an ellipse.

3. A strain relief for relieving strain on a cable, the strain relief comprising:
- a. a flexible housing having a cavity along its longitudinal axis:
- b. at least one posable insert which:
  - i. is disposed substantially parallel to, but outside the cavity; and
  - ii. is substantially surrounded by the flexible housing,
- c. wherein the shape of the posable insert is a rectangular plate which favors deformation along its shortest axis.

* * * * *